United States Patent [19]

Larker et al.

[11] 4,031,732

[45] June 28, 1977

[54] METHOD FOR HYDROSTATIC EXTRUSION OF TUBES

[75] Inventors: Hans Larker; Erik Lundblad; Bertil Lundback; Jan Nilsson, all of Robertsfors, Sweden

[73] Assignee: ASEA, Vasteras, Sweden

[22] Filed: May 22, 1975

[21] Appl. No.: 580,463

[30] Foreign Application Priority Data

June 7, 1974 Sweden ..... 7407507

[52] U.S. Cl. ..... 72/60; 72/264

[51] Int. Cl.[2] ..... B21C 25/04

[58] Field of Search ..... 72/56, 60, 264, 265, 72/266

[56] References Cited

UNITED STATES PATENTS

| | | | |
|---|---|---|---|
| 2,809,750 | 10/1957 | Arena | 72/479 X |
| 3,727,444 | 6/1973 | Nilsson | 72/60 |
| 3,751,957 | 8/1973 | Nilsson | 72/60 |
| 3,751,958 | 8/1973 | Nilsson et al. | 72/60 |
| 3,789,642 | 2/1974 | Nilsson | 72/60 |
| 3,807,032 | 4/1974 | Nilsson | 72/60 |
| 3,808,860 | 5/1974 | Yamaguchi et al. | 72/60 |
| 3,841,128 | 10/1974 | Nilsson | 72/60 |

*Primary Examiner*—Milton S. Mehr
*Attorney, Agent, or Firm*—Watson, Cole, Grindle & Watson

[57] ABSTRACT

In the hydrostatic extrusion of tubes in a press which has a pressure chamber containing a high pressure cylinder, a pressure generating portion insertable into the cylinder, a die arranged in the cylinder and a mandrel axially fixed in relation to the die and composed of a carrier portion and a tip, and in which the tip forms with the opening in the die a gap in which a tubular billet is shaped into a tube by hydrostatic extrusion, in connection with the insertion of the tubular billet, a seal is produced initially between the mandrel and the hole in the billet at a point between the front part of the mandrel carrier and the hollow wall of the billet. This may be done by producing a constriction of the front end of the hole in the billet before the mandrel is inserted therein or by upsetting the billet against the die.

3 Claims, 1 Drawing Figure

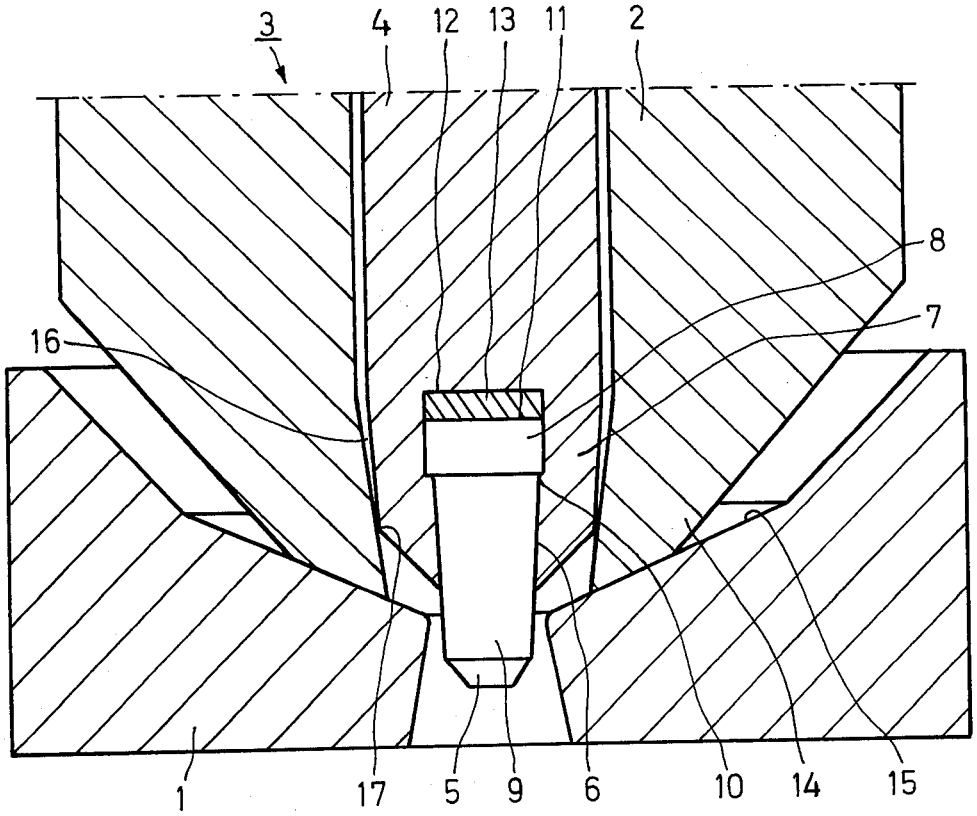
3
4
12
13
11
2
8
7
16
1
17
5
9
6
10
14
15

METHOD FOR HYDROSTATIC EXTRUSION OF TUBES

BACKGROUND OF THE INVENTION

1. Field of the Invention

The present invention relates to a method for achieving initial sealing between a mandrel and a billet in hydrostatic extrusion of tubes. The extrusion is carried out in a press with a high pressure chamber comprising a high pressure cylinder, a pressure generating punch insertable into the cylinder, a die arranged in the cylinder and a mandrel axially fixed in relation to the die during the extrusion and composed of a carrier and a tip attached to said carrier. Together with the opening in the die, the mandrel tip forms a gap in which a tube billet is shaped into a tube when the billet, by inserting the pressure generating punch into the cylinder, is subjected to a high, all-sided hydrostatic pressure in a pressure medium surrounding the billet.

SUMMARY OF THE INVENTION

According to the invention, the initial sealing between the mandrel and the hole of the tube billet is achieved when the billet is inserted between the outer part of the mandrel carrier and the hollow wall of the tube billet. The mandrel carrier seals against a constriction at the front part of the billet. This constriction can be achieved, either by upsetting the billet prior to insertion or by upsetting the billet against the mandrel in connection with the insertion in the press. A press where the upsetting for the sealing is achieved in connection with the insertion of the billet is described in more detail in U.S. Pat. No. 3,727,444. The advantages of the invention are, for one thing, that a sealing is achieved by a moderate upsetting of the billet tip, and for another that the area reduction will be small at the beginning of the extrusion, thus making the start easier. Furthermore, subject of the mandrel tip to great stresses when inserting the billet is avoided, and the pressure medium is prevented from penetrating into a bore in the mandrel carrier for the mandrel tip and presses out the mandrel tip. The method allows the mandrel tip to be attached without the help of soldering, which is particularly favourable in the case of hot extrusion where the heating of the mandrel may cause the soldered seam to be weakened or the strength of the solder to be reduced to such an extent that the mandrel tip can be pulled out of the mandrel carrier.

BRIEF DESCRIPTION OF THE DRAWINGS

The invention is described in more detail with reference to the accompanying drawing which is a cross-section through the extrusion portion of a press in which the process is being carried out.

In the drawing, 1 designates a die in a pressure chamber, the rest of which is not shown, in a hydrostatic extrusion press, 2 a tubular billet and 3 a mandrel comprising a mandrel carrier 4 and a mandrel tip 5. The mandrel tip is attached in a bore 6 at the front part 7 of the mandrel carrier 4. The inner part 8 of the mandrel tip has a greater diameter than the outer part 9, thus forming a shoulder 10. The front part 7 of the mandrel carrier has been pressed around the mandrel tip so that the tip is held axially fixed by the shoulder 10. Between the rear end surface 11 of the mandrel tip and the bottom 12 of the bore 6 there is inserted a plate 13 of the same material as in the mandrel carrier. The units are shown in a position immediately prior to the extrusion. The tip 14 of the tubular billet 2 makes contact with the inlet cone 15 of the die in a sealing manner. The billet tip 14 is upset so that the hole 16 at the front part of the billet has a smaller diameter than the front part 7 of the mandrel carrier. Initial sealing between mandrel and billet is obtained between the upset front part 14 of the billet and and the front edge 17 of the mandrel carrier. The billet can be upset prior to insertion into the pressure chamber, and the mandrel projects into the upset part so that the mandrel carrier is pressed against the inner surface of the hole 16. The billet can also be upset as it is inserted in a press with a billet holder pressing the billet against the die with a force necessary for upsetting the billet. Such press is described in the previously mentioned U.S. Pat. No. 3,727,444.

We claim:

1. Method for hydrostatic extrusion of tubes in a press with a pressure chamber containing a high pressure cylinder, a pressure generating punch insertable into the cylinder, a die arranged in the cylinder and a mandrel axially fixed in relation to the die and composed of a carrier and a separate tip mounted in the carrier, which tip together with an opening in the die forms a gap in which a tubular billet having a hole therein is shaped into a tube when the billet is subjected to an all-sided hydrostatic pressure in a surrounding pressure medium, which comprises, in connection with the insertion of the tubular billet (2), producing the initial sealing between the mandrel (3) and the hole of the tubular billet (2) by contact between the front part (7) of the mandrel carrier (4) and the hollow wall of the tubular billet (2).

2. Method according to claim 1, in which the mandrel carrier (4) seals against a constriction in the front part (14) of the tubular billet (2).

3. Method according to claim 2, which comprises forming the constriction by upsetting the billet (2) against the die (1) in connection with the insertion of the billet (2).

* * * * *